United States Patent [19]

Bayly

[11] 4,091,691

[45] May 30, 1978

[54] KNIFE SHARPENER

[75] Inventor: Peter Kingsley Bayly, Eltham North, Australia

[73] Assignee: Wiltshire Cutlery Company Proprietary Ltd., Melbourne, Australia

[21] Appl. No.: 746,119

[22] Filed: Nov. 30, 1976

[51] Int. Cl.[2] ..... B21K 11/02; B24B 3/54

[52] U.S. Cl. ..... 76/86; 51/214; 30/138

[58] Field of Search ..... 76/86, 88, 82; 51/214, 51/205 WG, 204; 30/138

[56] References Cited

U.S. PATENT DOCUMENTS

| | | | |
|---|---|---|---|
| 3,676,961 | 7/1972 | Jackson | 51/214 |
| 3,774,350 | 11/1973 | Bayly | 51/214 |
| 3,861,246 | 3/1974 | Walker | 51/214 |

*Primary Examiner*—Harold D. Whitehead
*Assistant Examiner*—Roscoe V. Parker
*Attorney, Agent, or Firm*—Diller, Brown, Ramik & Wight

[57] ABSTRACT

A knife sharpener including a scabbard for receiving and protecting a knife blade, and a sharpening device mounted on the scabbard for engagement by the blade cutting edge during movement into and out of the scabbard. The sharpening device is supported by a carrier member which is pivotally mounted within the scabbard so that the sharpening device can be moved towards and away from a top wall of the scabbard. A pivoted reaction member is located between the scabbard top wall and the carrier member, and has front and rear reaction zones which are engageable with a knife blade and/or the adjacent surface of the carrier member, at opposite sides respectively of the carrier member pivot. The reaction member pivot is located rearward of both reaction zones and is parallel to the carrier member pivot. A U-shaped biasing spring engages both the carrier member and the reaction member to resist separation of their front end portions.

12 Claims, 18 Drawing Figures

KNIFE SHARPENER

This invention relates to knife blade sharpeners, and is particularly concerned with such sharpeners as embodied in a scabbard or protective sheath for a knife blade. Such sharpener-scabbard combinations form the subject of Australian Pat. Nos. 424,122 and 447,537.

Combinations of the above kind include means whereby a force is maintained between the sharpening mechanism and a knife blade inserted into the scabbard and engaging the sharpening mechanism. That force may be achieved by a biasing spring acting directly or indirectly on the blade and/or the actual sharpening mechanism. With these mechanisms, it has been found difficult to arrange the various reaction zones so that a smooth sharpening operation can be achieved.

It is a principal object of the present invention to provide a scabbard-sharpener combination of the kind indicated in which the aforementioned difficulty is alleviated or overcome. It is a further object of the invention in a preferred form, to provide such a combination which is adapted to form a substantially constant cutting angle on a knife blade.

With regard to the last mentioned object, in using combinations of the kind indicated, it is necessary to ensure that the blade is maintained in contact with the actual sharpening device throughout the sharpening movement, and that the disposition of the blade relative to the sharpening device is such that the cutting angle of the blade is substantially constant throughout the blade length. The construction disclosed in Australian Pat. No. 447,537 satisfies the first requirement to some extent, but not the second. The primary difficulty is that a person operating the sharpener, can rock the knife blade relative to the sharpening device as that blade is moved across the sharpening device, and thereby cause alteration in the cutting angle of the blade.

The cutting angle of the blade is the angle subtended by the angularly disposed faces of the blade which define the cutting edge. Obviously, the relative disposition of those faces, and consequently the cutting angle, is dependent on the form of the sharpening recess provided by the sharpening device, and the disposition of the lower edge of the blade relative to the general plane of that recess. If that relative disposition alters during sharpening, so will the resulting cutting angle of the blade, and such alteration frequently occurs in the prior constructions because of insufficient care on the part of the user.

According to one aspect of the present invention, there is provided a knife sharpener including; a main body, a carrier member pivotally mounted on said main body, a sharpening device attached to a front portion of said pivot member at a position forward of the axis of said pivot mounting and so as to be exposed to an upper side of said carrier member; a reaction member pivotally mounted on said main body so as to overlie at least part of said carrier member upper side and having front and rear reaction zones located forwardly and rearwardly respectively of said carrier member pivot axis and each being arranged in opposed relationship to said upper side, and the axis of said reaction member pivot being substantially parallel to said carrier member pivot axis and being located rearwardly of said rear reaction zone; and biasing means urging the two said members about their respective pivots so as to resist separation of said front portion and said front reaction zone.

In a preferred arrangement, the front reaction zone is operative to engage the top edge of a knife blade inserted between the carrier and reaction members and engaging the sharpening device, and the rear reaction zone is operative to engage the upper side of the carrier member during at least an initial part of each sharpening operation. It is necessary however, that the aforementioned initial part is such that the knife blade extends to some degree rearward of the sharpening device. That is, when the knife blade has only limited penetration beyond the sharpening device, the rear reaction zone engages the upper side of the carrier member, but as that penetration is extended a stage may be reached at which the rear reaction zone separates from that upper side. It is also preferred that in the condition last described, the cutting edge of the knife blade engages a rubbing surface provided on the carrier member rearwardly of the carrier member pivot, so that the carrier member is maintained relatively stable about its pivot, but can rock about that pivot to suit the particular disposition of the knife blade.

According to another aspect of the invention, there is provided a knife sharpener including; a main body having a cavity in a front portion thereof, a sharpening device mounted within said cavity, and a guide section pivotally connected to said main body for movement between an operative position and an inoperative position, said guide section having a slot therein for receiving a knife blade and aligning that blade for engagement with said sharpening device when said guide section is in said operative position, and said guide section also functions as a cover for said cavity when in said operative position, whereby movement of said guide section in to said inoperative position exposes said sharpening device for servicing.

With the last mentioned aspect, servicing (e.g., cleaning, maintaining or replacing) of the sharpening device is facilitated by provision of the pivoted cover, and operation of the device is not impaired as that cover doubles as a guide for the knife blade during sharpening operations. Such a sharpener arrangement is especially useful in an assembly involving a reaction member as described above, particularly when installed in a scabbard housing, but that is not the only possible application of the sharpener. Quite obviously, a sharpener as described can be used externally of a scabbard and without a cooperating reaction member.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

In the drawings

Figures 1, 2, 3:
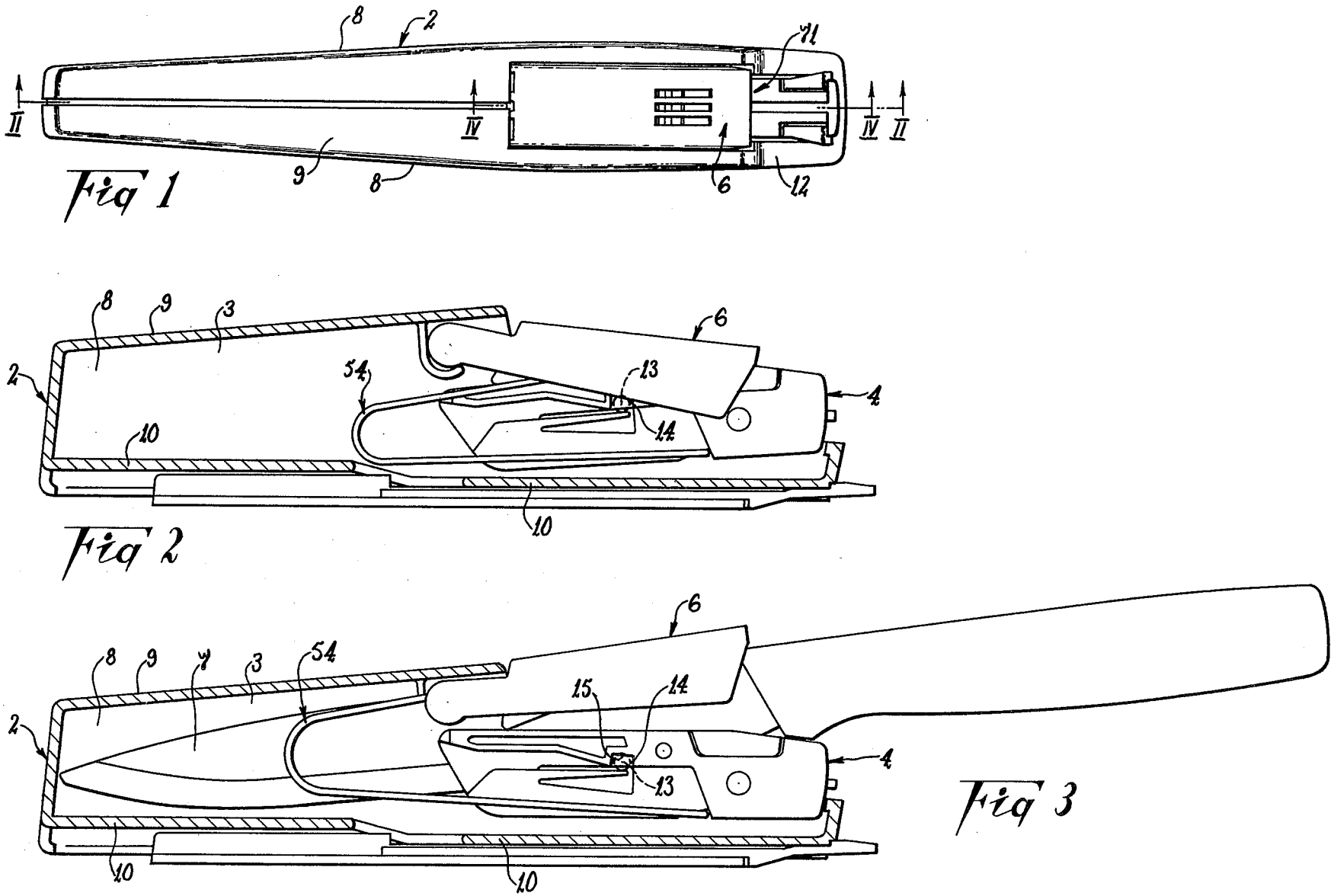
FIG. 1 is a plan view of an example embodiment of the invention.
FIG. 2 is a longitudinal cross-sectional view taken along line II—II of FIG. 1.
FIG. 3 is a view similar to FIG. 2 but showing a knife blade inserted into the scabbard.

A sharpener according to a preferred application of the invention as shown in the drawings, includes the basic components of the construction as disclosed by Australian Pat. No. 447,537. That is, it includes a hollow housing 2 defining a knife receiving passage 3 (FIGS. 2 and 3), a carrier member 4 pivotally mounted in the housing 2 and supporting a sharpening device 5 (FIGS. 5 and 6), and a reaction member 6 adapted to coact with a knife blade 7 (FIGS. 3, 5 and 6) inserted into the housing 2. In such constructions, biasing means is required to create pressure between the sharpening device 5 and the knife blade 7 so that effective sharpening results, and in the constructions prior to the present invention, that biasing means usually took the form of a spring which acts between the housing 2 and the knife blade 7, or a component of the sharpener such as the carrier 4.

In the sharpener according to the invention, the carrier 4 is mounted for rocking movement so as to adapt to positions of an engaging knife blade, and the reaction member 6 is also pivotally mounted on the housing 2 and is arranged to engage the carrier 4 and a knife blade 7 in such a way as to achieve a relatively smooth sharpening action. It is a further feature of the invention, in a preferred form, that the biasing means acts between two relatively movable parts of the sharpener assembly so that it is difficult for the knife blade 7 to be moved clear of the sharpening device during a sharpening operation.

Relative terms such as "upper", "lower", "front" and "rear" will be used throughout this specification in describing an embodiment of the invention. Such terms are used for convenience only, and are not to be understood as placing a limitation on the way in which the sharpener is to be disposed when in use.

The housing 2 may be generally as described in Australian Pat. No. 447,537. In particular, the knife receiving passage 3 is defined between opposed side walls 8, a top wall 9, and a base 10 of the housing 2, and an access opening 11 is provided at a front end 12 of the housing 2. The carrier 4 is preferably an elongated member which is located in the knife receiving passage 3 so as to extend generally lengthwise of that passage, and is pivotally connected to the housing at a location inwardly of the access opening 11. In the particular construction shown, that the pivot connection (hereinafter described) is located intermediate the ends of the carrier, and is arranged so that the carrier 4 is capable of release from that connection to permit withdrawal of the carrier 4 through the access opening 11 and out of the housing 2.

Figure 5:
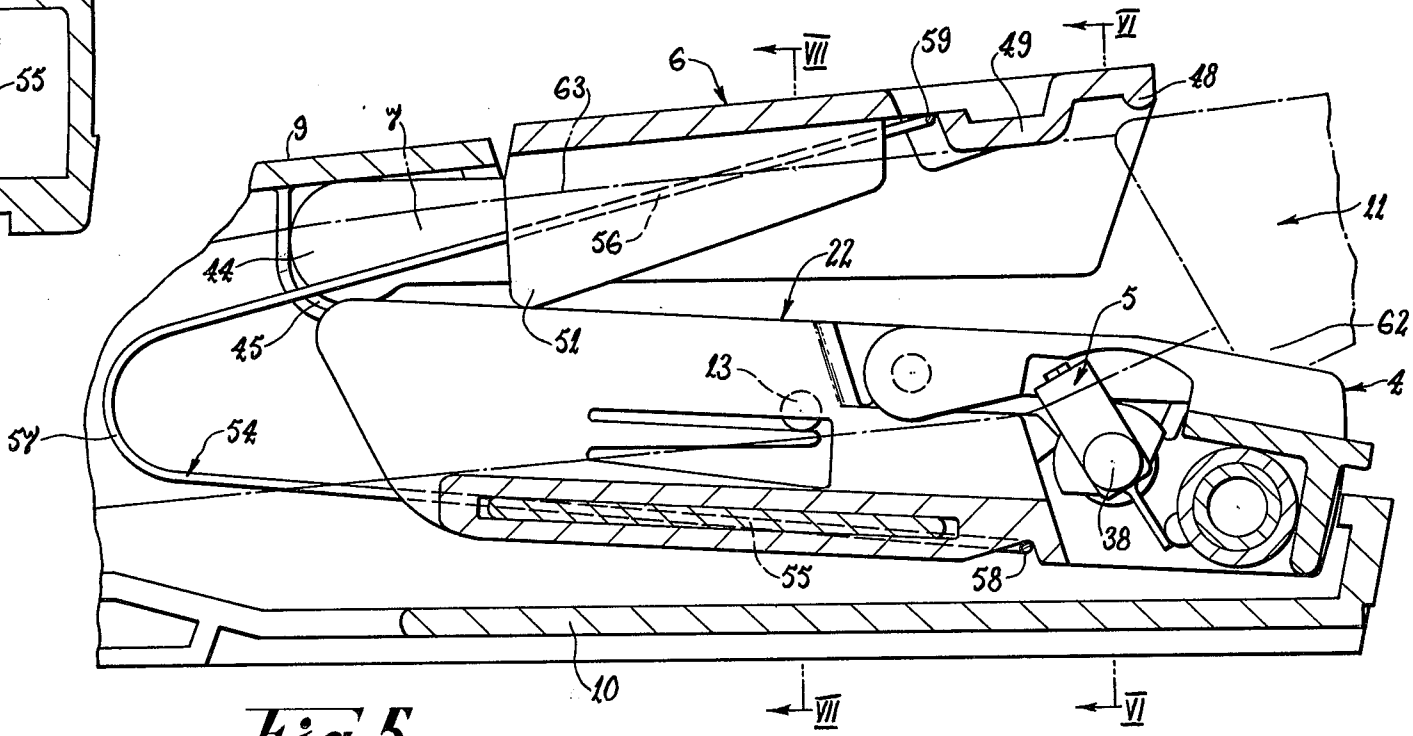
FIG. 5 is a view similar to FIG. 4 but showing a knife blade engaging the sharpening device.
Figure 7:
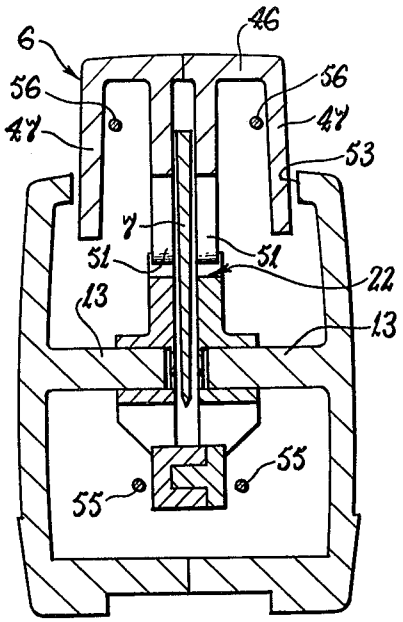
FIG. 7 is a cross-sectional view taken along line VII—VII of FIG. 5.

The preferred carrier pivot arrangement is best shown in FIGS. 3, 5 and 7, and comprises two cylindrical axle sections 13 which project inwardly from respective side walls 8 of the housing 2 and which locate within a recess 14 formed in the adjacent side of the carrier 4. The upper surface 15 of each recess 14 defines a bearing surface, which may be arcuate or flat as shown, and the associated axle section 13 is maintained in engagement with the surface 15 by resilient retention means, although other means could be employed for that purpose. According to the arrangement shown, the resilient retention means comprises a leaf spring 16 formed integral with the body of the carrier 4 and adapted to engage beneath each axle section 13. A separate leaf spring 16 is preferably provided for each axle section 13 so that a space exists between the springs 16 for passage of a knife blade 7, but in some circumstances a single spring 16 can act on both axle sections 13. Also, the or each spring 16 could be attached to the body of the carrier 4 rather than being formed integral therewith. The upper surface 17 of each leaf spring 16 in the construction shown, forms the base of a lead-in groove 18 on each side of the carrier 4 whereby the axle sections 13 are guided into position as the carrier 4 is inserted into the housing 2. Such an arrangement permits the carrier 4 to be snap engaged into position, and allows ready release of the carrier 4 from its pivotal mounting.

In the particular construction shown in the drawings, the front end portion 19 of the carrier 4 projects beyond the housing access opening 11, and the sharpening device 5 is mounted on the carrier 4 adjacent the opening 11. The sharpening device 5 may be mounted, as shown, for limited rocking movement relative to the carrier 4, and defines a substantially V-shaped sharpening recess 21 (FIG. 8) which is located below the uppermost surface 22 (FIG. 9) of the carrier 4, at least during normal operation of the assembly. The sharpening device 5 is exposed to the upper surface 22 of the carrier 4 through a knife receiving slot 23 (FIG. 8) which extends lengthwise of the carrier 4, preferably on both the forward and rearward sides of the sharpening device 5. Side surfaces of at least portion of the slot 23 function as guide surfaces to resist lateral tilting of a knife blade 7 inserted into the housing 2. The base 24 (FIG. 9) of the slot portion 23*a* in the forward section of the carrier 4 may also serve to guide a knife blade 7 into the sharpening recess 21 at an appropriate level, and at least part of the base 25 of the slot portion 23*b* rearwardly of the sharpening device 5 provides a rubbing surface which is engageable by the blade cutting edge 26 for a purpose hereinafter described. If desired, the upper surface 27 of the forwardly projecting portion 19 of the carrier 4 may form a ramp surface which is cooperable with a knife handle 28 (see FIG. 3) as also hereinafter described.

The sharpening device 5 may be formed in any suitable manner — for example, as is described in either of Australian Pat. Nos. 447,537 and 424,122 — and may be connected to the carrier in a manner similar to that described in Australian Pat. No. 447,537.

Figure 8:
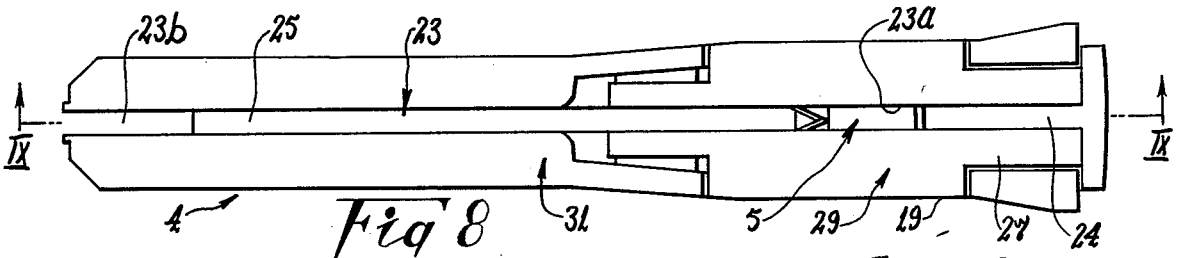
FIG. 8 is a plan view of the carrier member shown in the preceding views.
Figure 9:
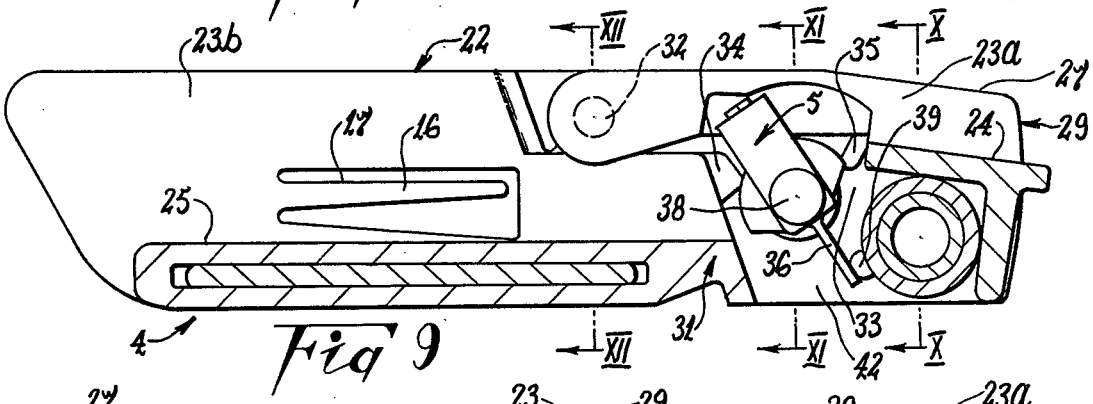
FIG. 9 is a cross-sectional view taken along line IX—IX of FIG. 8.
Figure 10:
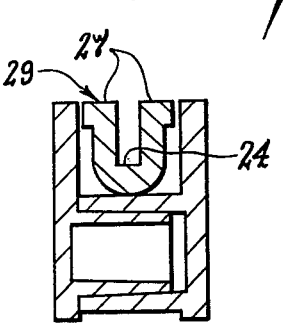
FIGS. 10 to 12 are transverse cross-sectional views taken along lines X—X, XI—XI and XII—XII respectively of FIG. 9.

The preferred carrier 4 shown in FIGS. 8 to 13 of the drawings, includes a guide section 29 which is pivotally connected to the main body 31 of the carrier 4 for movement between an operative position and a raised inoperative position. In the operative position, as shown in FIGS. 8 and 9, the guide section 29 defines part of the upper surface 22 of the carrier 4 and includes slot portion 23*a* which provides side guide surfaces for a knife blade 7. It is preferred, as shown, that in the operative position, the guide section 29 extends both forwardly and rearwardly of the sharpening device 5. The pivotal connection 32 between the carrier body 31 and the guide section 29 is preferably located adjacent the rear end of the guide section 29, so that when that section is swung upwardly (see FIG. 13) it exposes the sharpening device 5 and a cavity 33 in the main body 31 of the carrier 4 which contains the sharpening device 5. Consequently, in that inoperative position, the sharpening device 5 can be serviced as required (e.g., cleaned), and debris resulting from sharpening operations can be cleared from the cavity 33. The arrangement is such that the guide section 29 can be moved into the raised inoperative position while the carrier 4 is in its normal position within the housing 2, but it is usually convenient to do that when the carrier 4 is removed from the housing 2. Any suitable means such as a snap engageable latch may be employed to releasably retain the guide section 29 in its operative position.

It is preferred that rocking movement of the sharpening device 5 relative to the guide section 29 is limited by stops 34 and 35 formed on at least one side of the cavity 33, and that spring means 36 is provided to urge the sharpening device 5 towards a mean position. In the construction shown, the spring means 36 comprises a leaf spring formed integral with a mounting block 37 of the sharpening device 5, and that spring (or any alternative spring means as may be employed) is arranged to provide the bias adjacent one side only of the sharpening device 5. That is, the line of action of the bias is located laterally of the centre line of the sharpening recess 21, and in that way a slight twist is imposed on the sharpening device 5 which compensates for any clearance in its pivotal mounting 38 (FIGS. 6, 9 and 11) and thereby tends to eliminate chatter during sharpening operations.

Figure 11:
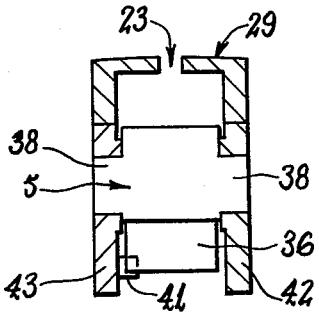
Figure 12:
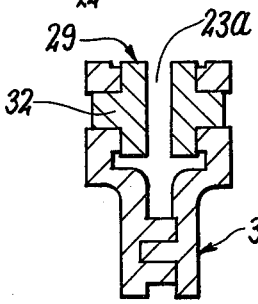
Figure 13:
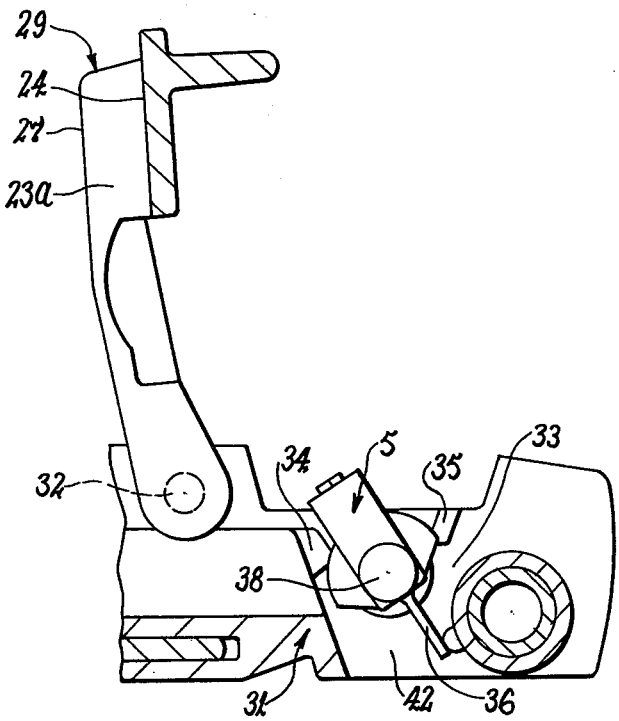
FIG. 13 shows part only of the carrier member of FIG. 9, with the guide section moved into an inoperative position.

FIGS. 9 and 11 show one particular method for achieving the laterally disposed or offset bias in such a way that the bias is at respective opposite sides of the sharpening recess 21 at each of the two limit positions of the sharpening device 5. The two limit positions are those at which the sharpening device 5 engages the stops 34 and 35 respectively. The offset bias is achieved by abutments 39 and 41 which project inwardly from respective side walls 42 and 43 of the cavity 33 containing the sharpening device 5, and they are located so that each is effective to product the bias and twist as mentioned above, in a respective one of the limit positions of the sharpening device 5.

It will be seen from FIGS. 8 to 12 that the carrier member 4 can be simply moulded from a suitable plastics material, and assembled with little difficulty. In particular, the body 31 of the carrier member 4 comprises two principal parts which can be easily assembled over the sharpening device 5 and the guide section 29.

The reaction member 6 in the preferred construction so far described, is located between the housing upper wall 9 and the adjacent upper surface 22 of the carrier 4, and is pivotally connected to the housing 2 for movement about an axis extending substantially parallel to the pivotal axis of the carrier 4. The location of that pivotal connection is preferably adjacent the housing upper wall 9 and some distance inwardly of the access opening 11 — for example, adjacent the rear end of the carrier 4. Any suitable means may be employed to form that connection, but in the preferred construction shown, it comprises a part cylindrical end section 44 of the reaction member 6 which is snap engageable within aligned recesses 45 provided in the two side walls 8 of the housing 2 (see FIG. 2). In that arrangement, the reaction member 6 may be released from the recesses 45 and withdrawn through the front end of the housing 2 if required.

Figure 4:
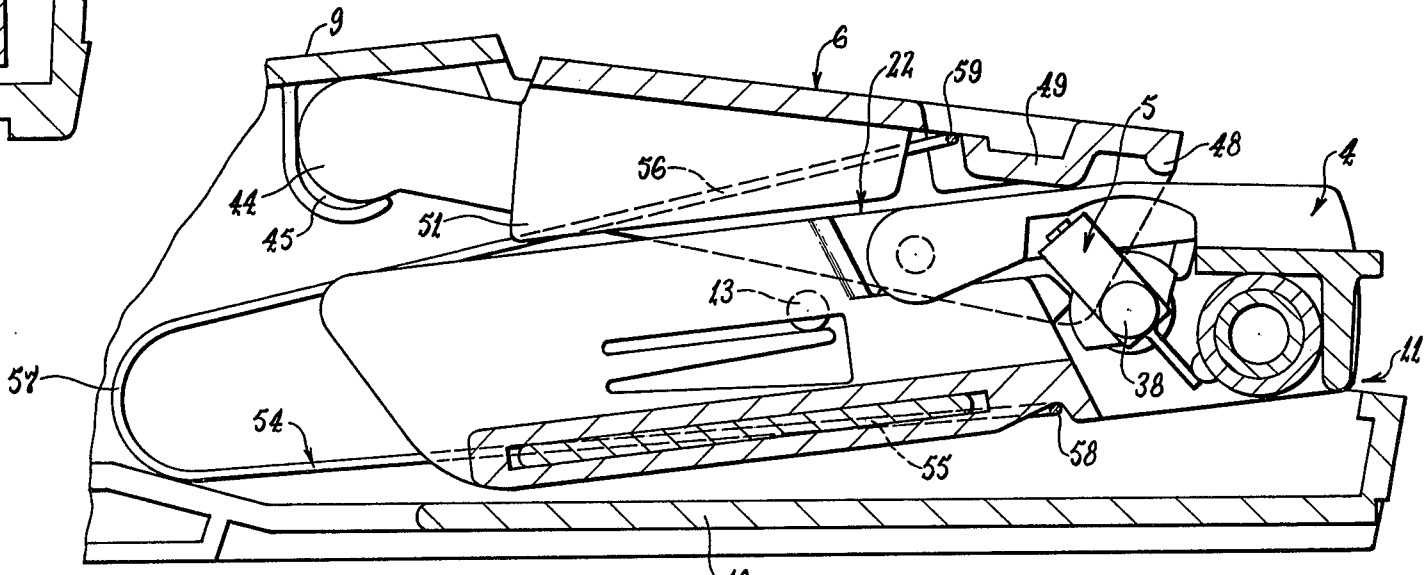
FIG. 4 is a cross-sectional view taken along line IV—IV of FIG. 1.
Figure 6:
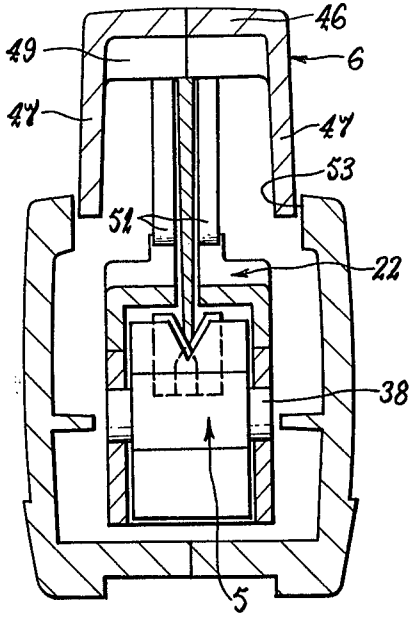
FIG. 6 is a cross-sectional view taken along line VI—VI of FIG. 5.

In the form shown, the reaction member 6 is shaped somewhat as an inverted channel in cross-section so as to define an upper wall 46 and two depending side walls 47 (see FIGS. 6 and 7). The front end of the upper wall 46 is adapted to bear on or lie close to the carrier upper surface 22, preferably slightly forward of the sharpening device 5, in the rest or closed condition of the scabbard (FIG. 2) and may be provided with a downwardly projecting lip 48 for that purpose. A front reaction zone is provided on the upper wall 46 of the reaction member 6 rearwardly of the lip 48, and in the construction shown, it is formed by a downwardly projecting section 49 of the wall 46. That zone 49 is preferably located almost directly above the sharpening device 5, although it could be positioned slightly rearwardly of that device if desired. In addition, a rear reaction zone is provided intermediate the reaction member pivot 44, 45, and the carrier pivot 13, 14, and in the construction shown, that reaction zone is defined by two downward projections 51 of the reaction member upper wall 46, which projections 51 are engageable with the carrier upper surface 22 (see FIG. 4).

It is a feature of the invention that the pivot connection 44, 45 of the reaction member 6 is located rearwardly of the two reaction zones 49 and 51. Such an arrangement contributes to successful operation of the sharpener by permitting establishment of a desirable force relationship. A further benefit of the pivot location is that it enables the front end of the reaction member 6 to be moved through a substantial distance towards and away from the base 10 of the scabbard housing 2, and in that way allows the scabbard to accept knife blades 7 of a wide range of depths.

When the scabbard is in the closed condition (FIGS. 2 and 4), the rear reaction zone 51 preferably engages the carrier upper surface 22 at a location between the pivot 13, 14 and rear end of the carrier 4, and the front reaction zone may also engage the surface 22 but forwardly of the carrier pivot 13, 14. In any event, there is at least one zone of engagement between the reaction member 6 and the carrier 4, and that is preferably at the rear reaction zone 51.

Also in the closed condition, the upper wall 46 of the reaction member 6 preferably forms a forward continuation of the upper wall 9 of the housing 2, although it may slope downwardly from the front edge 52 of the housing wall 9 as shown in FIG. 2. The front edge 52 of the housing upper wall 9 is preferably located some distance rearwardly of the front edge of each housing side wall 8 so providing a gap 53 (FIG. 1) through which the reaction member 6 can be lifted about its pivot. In such a lifted condition however, the reaction member side walls 47, which are slidably located between the housing side walls 8, preferably extend below the upper edges of the housing side walls 8 so as to retain a neat appearance and provide substantially complete encapsulation of a knife blade 7.

The biasing means in the preferred construction shown, acts directly on the reaction member 6, and in that respect is distinguished over prior art constructions in which the biasing means acts on the knife blade or a pivoted carrier for the sharpening device. It is usually preferred to use a leaf or wire spring as the biasing means, and to arrange such a spring to act on the reaction member 6 forwardly of the axis of pivot 44, 45 so as to force the front end downwardly towards the base 10 of the scabbard housing 2. If desired, the biasing means may comprise two separate sections which act independently of each other against the carrier 4 and the reaction member 6 respectively so as to normally hold those members in a closed condition as shown in FIG. 2. Preferably however, the biasing means acts between those two members 4 and 6, and for that purpose may comprise a one-piece somewhat U-shaped spring 54 as shown in the drawings. If desired, there may be one such spring adjacent each side of the carrier 4.

The particular biasing spring 54 shown, includes two legs 55 and 56 interconnected through a curved bight portion 57 which, in the operative position of the spring 54 as shown in the drawings, is located in the housing passage 3 rearwardly of both the carrier 4 and the reaction member 6, and the two legs 55 and 56 extend forwardly in the direction of the passage 3. The forward end portion 58 of the leg 55 engages the carrier 4, preferably directly below the sharpening device 5, and the forward end portion 59 of the leg 56 engages the reaction member 6, also preferably adjacent the sharpening device 5 and/or in the region of the reaction zone 49. Such a biasing spring is arranged to apply a scissors action between the reaction member 6 and the carrier 4 so that the former is urged downwardly about its respective pivot 44, 45 and the latter is urged upwardly about its pivot 13, 14.

It is preferred that the scabbard housing 2 is arranged so that a knife blade 7 can be inserted into the passage to such depth that the heel or choil 61 of the blade 7 is located rearwardly of the sharpening device 5 (see FIG. 5), and thereby permits substantially full length sharpening of the blade cutting edge 26. In that fully inserted position, part 62 of the knife handle 28 may rest on the ramp surface 27 of the carrier 4 so that the blade is retained at an appropriate height for withdrawal back across the sharpening device 5. That ramp surface 27 is preferably sloped as shown so that during the final part of the insertion of a knife blade 7 into the housing 2, the blade 7 is lifted progressively to permit sharpening of a curved choil 61.

Figure 14:
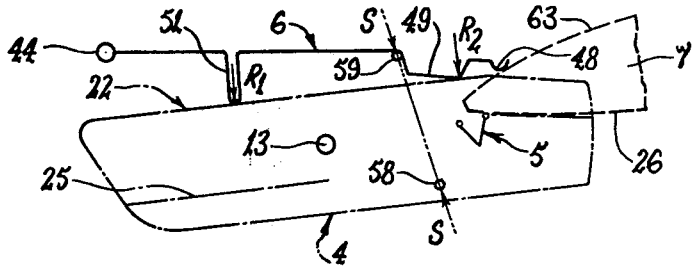
FIGS. 14 to 18 are diagrammatic views showing the various reactions and lines of force at different stages of a single sharpening operation using the construction shown in the preceding figures.

When a knife blade 7 is first inserted into the scabbard described, the upper edge 63 preferably engages the front lip 48 of the reaction member 6 at substantially the same time as the cutting edge 26 engages the sharpening device 5, as is shown diagrammatically in FIG. 14. At that stage, the spring force S resists separation of the members 4 and 6, and the member 4 is maintained in equilibrium about the pivot 13 by the reactions $R_1$ and $R_2$ at the zones of engagement between the members 4 and 6.

Figure 15:
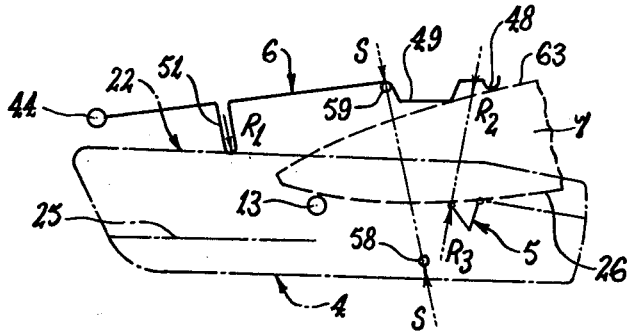

As the blade 7 is moved deeper into the housing 2, the front end of the carrier 4 is caused to swing downwardly about the pivot 13 because of the pressure applied at the sharpening device 5, and the blade upper edge 63 contacts the front reaction zone 49 of the reaction member 6 (see FIG. 15). At the same time, the front end of the reaction member 6 is caused to swing upwardly about its pivot 44 because of the engagement between zone 49 and the blade upper edge 63. The rear reaction zone 51 of the reaction member 6 is still in engagement with the carrier 4 and consequently keeps the carrier 4 in a satisfactory position relative to the knife blade 7.

Figure 16:
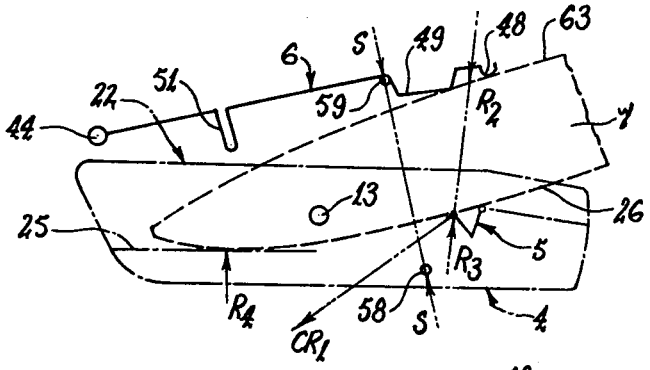

In the particular form of the invention shown, continued movement of the knife blade 7 into the housing 2 results in the blade cutting edge 26 engaging the rubbing surface 25 rearwardly of the sharpening device 5, so that the blade 7 then has two point engagement with the carrier 4 on opposite sides respectively of the carrier pivot 13 (see FIG. 16). At or about that time, the rear reaction zone 51 of the reaction member 6 may be lifted clear of the carrier 4 and the knife blade 7, the sharpening device 5 can function to form a substantially constant cutting angle on the blade 7. It may be, however, that the carrier 4 and the reaction zone 51 remain in engagement during the entire sharpening operation.

When the FIG. 16 condition has been reached, the reaction forces are such that the carrier 4 and blade 7 retain the particular relationship regardless of the disposition of the blade 7 relative to the housing 2. Reaction $R_1$ no longer exists because of separation of the zone 51 from the carrier 4, but reaction $R_4$ between the blade 7 and carrier 4 stabilizes the carrier 4 in that it balances the reaction $R_3$ on the opposite side of the pivot 13. Thus, assuming that the knife blade 7 is maintained at a particular position of insertion and the knife handle 28 is moved upwardly or downwardly relative to the housing 2, the relative positions of the reaction member 6, carrier 4, and knife blade 7 will remain the same within the limits of movement of the first mentioned two components 6 and 4.

As a result of the foregoing, the relative positions of the carrier 4 and knife blade 7 are controlled in such a way that the sharpening device 5 can function to produce a substantially constant cutting angle on the blade. Any change in those relative positions as will naturally occur because of the changing configuration of the blade 7 as it is inserted further into the housing 2, may be such as to substantially compensate for that change in configuration so that the cutting angle is maintained substantially constant.

Figure 17:
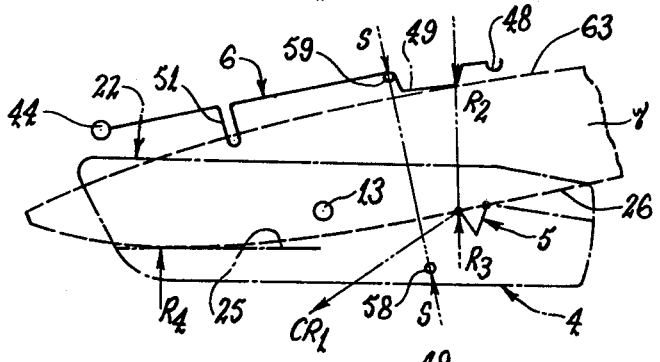
Figure 18:
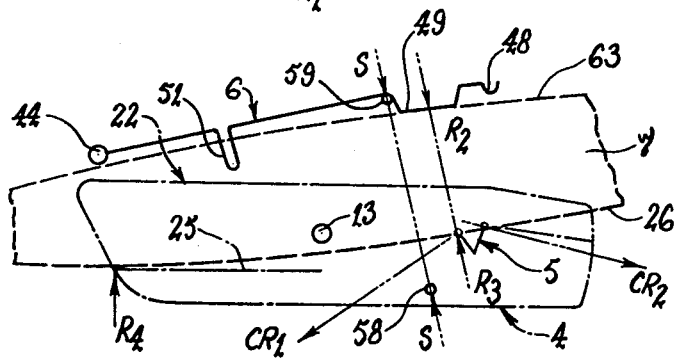

FIGS. 17 and 18 shown the blade 7 at progressively greater stages of penetration into the housing 2. Line $CR_1$ in FIGS. 16 to 18 represents the line of the direction of the force applied between the blade 7 and the cutters of the sharpening device 5 during inward movement of the blade 7. It will be seen that the angular relationship between that line and the longitudinal axis of the blade 7 does not vary significantly throughout, so that there is little variation in the resistance to sharpening during the entire operation. The line $CR_2$ in FIG. 18 represents the direction of the cutter resistance force during withdrawal of the blade 7 from the housing 2, and the angular relationship between line $CR_2$ and the blade longitudinal axis is much the same as that between line $CR_1$ and the blade longitudinal axis.

It will be appreciated from the foregoing that a proper relationship between the knife blade 7 and the sharpening device 5 is maintained during movement of the blade 7 into and out of the scabbard housing 2. That results from the two point engagement with the carrier 4, which is achieved during at least part of that movement by engagement of the knife blade 7 and the reaction member 6 respectively at spaced zones. In the particular arrangement described, during part of the blade movement, the aforementioned relationship is achieved by engagement of the carrier 4 with two spaced zones of the blade 7. It is also relevant that the two zones of engagement with the carrier 4 are on opposite sides of the carrier pivot 13, so that the blade 7 and carrier 4 rock about that pivot 13 without loss of the desired relationship, should the knife handle 28 be moved up or down relative to the scabbard housing 2. The reaction member 6 will of course follow any such movement of the carrier 4 and blade 7 because of its pivotal mounting 44, 45 and bias condition. When the knife blade 7 is being withdrawn from the housing 2, there will be the same control over the blade 7 and sharpening device 5 relationship.

A construction as described has several advantages over prior scabbard-sharpener combinations. For example, it has the ability to maintain a substantially constant cutting angle on the knife blade in the manner described above. In the preferred construction described in which the carrier and reaction member are biased by the same spring, the foregoing feature is especially pronounced because of the dynamic nature of the resulting sharpening assembly. That is, the assembly (carrier, reaction member and biasing spring) is able to move relative to the housing without disturbing the biasing force, which is the pressure between the knife blade and the sharpening device and without disturbing the blade and the sharpening device relationship.

Another advantage results from the rearwardly located engagement between the reaction member and the carrier, during initial insertion of a knife blade. The location of that engagement provides suitable compensation between the force acting between the blade and sharpening device and that applied to the knife handle by the user, and that location will usually be dependant to some degree on the profile of the blade to be sharpened. In all instances however, it will be between the carrier and reaction member pivots and rearwardly of the former.

Still another advantage arises from the two point connection between the knife blade and the carrier. As the knife blade engages the aforementioned rubbing surface (which may be provided by an insert of suitable material attached to the carrier, or it may be a integral part of the carrier) it is also in engagement with the sharpening device, and the result is that there is a reduction of the force applied to the sharpening device. In practice that reduction might be as high as 50%. It is found that the load on the sharpening device is seldom constant because of fluctuations in pressure as applied by the user, and the effective reduction in load as resulting from the aforementioned arrangement enables a greater control of the sharpening operation.

Yet another advantage results from the provision of a lead-in guide surface formed by the base of the blade receiving slot on the front side of the sharpening device, as that facilitates entry of the knife blade into the scabbard. Also, the ramp surface engagement with the knife handle allows the sharpening action to proceed past the choil of the blade and prevents the knife handle dropping at the completion of the inward sharpening operation. Consequently, withdrawal of the blade from the scabbard is not hindered and the outward sharpening operation may be effected in a convenient and simple manner.

Various alterations, modifications and/or additions may be incorporated into the invention particularly described without departing from the spirit or scope of the invention as defined by the appended claims.

Having now described my invention, what I claim as new and desire to secure by Letters Patent is:

1. A knife sharpener including; a main body, a carrier member pivotally mounted on said main body, a sharpening device attached to a front portion of said carrier member at a position forward of the axis of said pivot mounting and so as to be exposed to an upper side of said carrier member; a reaction member pivotally mounted on said main body so as to overlie at least part of said carrier member upper side and having front and rear reaction zones located forwardly and rearwardly respectively of said carrier member pivot axis and each being arranged in opposed relationship to said upper side, and the axis of said reaction member pivot being substantially parallel to said carrier member pivot axis and being located rearwardly of said rear reaction zone; and biasing means urging the two said members about their respective pivots so as to resist separation of said front portion and said front reaction zone.

2. A knife sharpener according to claim 1, wherein said carrier member has a knife blade receiving slot formed in said upper side thereof, at least in the portion of said carrier member extending rearward of the pivot thereof, and a knife blade engaging surface forms at least part of the base of said slot at a location rearward of said carrier member pivot.

3. A knife sharpener according to claim 2, wherein a forward portion of said slot is formed in a guide section pivotally mounted on said carrier member for movement between operative and inoperative positions, said sharpening device is mounted in a cavity in said carrier member front portion, said guide section forms a cover for said cavity when in said operative position whereby a knife blade can be engaged with said sharpening device only by insertion through said slot forward portion, and said guide section exposes said sharpening device for servicing when in said inoperative position.

4. A knife sharpener according to claim 1, wherein said carrier member is snap engageable with each of two axle sections formed on respective opposite side walls of said main body, so as to provide said pivot mounting of the carrier member.

5. A knife sharpener according to claim 4, wherein each said axle section locates in a recess formed in said carrier member and is releasably retained in that location by a leaf spring forming part of said carrier member.

6. A knife sharpener according to claim 1, wherein said front reaction zone is operative to engage the top edge of a knife blade inserted between said carrier and reaction members and engaging said sharpening device, and said rear reaction zone is operative to engage said carrier member upper side, at least during an initial part of each blade sharpening operation.

7. A knife sharpener according to claim 1, wherein said biasing means comprises a U-shaped spring having two legs interconnected through a curved bight portion, each said leg engaging a respective one of said carrier and reaction members forwardly of their pivots so as to urge the front portions of those members towards each other.

8. A knife sharpener according to claim 1, wherein said main body is an elongate housing having a knife blade receiving passage extending lengthwise thereof and an access opening for said passage at a front end of the housing, and said carrier member is mounted on said housing so that said sharpening device is located at or adjacent said access opening.

9. A knife sharpener including; a main body having a cavity in a front portion thereof, a sharpening device mounted within said cavity, a guide section having a configuration for forming a continuation of said main body and forming a cover for said cavity and said sharpening device, and pivot means pivotally connecting said guide section to said main body for movement between a normal operative position forming a cover for said cavity and an inoperative position projecting away from said main body and said cavity and exposing said sharpening device for servicing, said guide section having a slot therein for receiving a knife blade and aligning that blade for engagement with said sharpening device when said guide section is in said operative position.

10. A knife sharpener according to claim 9, wherein pivot means pivotally mount said sharpening device within said cavity for movement between two limit positions, spring means is associated with said sharpening device and operative when said sharpening device is in either of said limit positions to bias said sharpening device towards the other of said limit positions, and the relationship of said spring means and said sharpening device is one wherein said bias is applied to said sharpening device at a location lateral of the zone of engagement between said sharpening device and a knife blade when in use.

11. A knife sharpener according to claim 10, wherein said bias is applied at respective opposite sides of said zone of engagement in each of said limit positions.

12. A knife sharpener including;

a main body having a cavity in a front end portion thereof, said cavity having an open mouth;

a sharpening device pivotally mounted within said cavity for movement a predetermined direction between two limit positions, and having a sharpening recess therein for receiving a knife blade;

spring means attached to said sharpening device for movement thereof;

two stops carried by said main body in spaced apart relation in the direction of movement of said sharpening device and in a direction transverse to said predetermined direction of movement, each of said stops being located on a respective opposite side of said sharpening recess, and a respective one of said stops each being engaged by said spring means when said sharpening device is in a respective one of said two limit positions; and a cover member, pivotal means pivotally connecting said cover member to said main body for movement between an operative position in which said cover member extends across said open mouth of said cavity and an inoperative position in which said open mouth is exposed, said cover member having a slot therein for receiving a knife blade and aligning that blade for location within said sharpening recess when said cover member is in said operative position.

* * * * *